US007150604B2

(12) United States Patent
Girod et al.

(10) Patent No.: US 7,150,604 B2
(45) Date of Patent: Dec. 19, 2006

(54) ELECTRIC BOX FOR COMPRESSOR ASSEMBLY

(75) Inventors: Xavier Girod, Montluel (FR); Michel Augagneur, Civrieux (FR); Jean De Bernardi, Lyons (FR); Renaat Vandelanotte, Ghent (BE)

(73) Assignee: Carrier Corporation, Farmington, CT (US)

( * ) Notice: Subject to any disclaimer, the term of this patent is extended or adjusted under 35 U.S.C. 154(b) by 445 days.

(21) Appl. No.: 10/801,730

(22) Filed: Mar. 15, 2004

(65) Prior Publication Data

US 2005/0201871 A1 Sep. 15, 2005

(51) Int. Cl.
*F04B 17/03* (2006.01)

(52) U.S. Cl. ..... 417/410.1; 417/572; 417/902

(58) Field of Classification Search ..... 417/410.1, 417/572, 902
See application file for complete search history.

(56) References Cited

U.S. PATENT DOCUMENTS 4,467,385 A * 8/1984 Bandoli et al. ..... 361/24
6,150,735 A * 11/2000 Hisamoto ..... 307/10.6
6,375,439 B1 * 4/2002 Missio ..... 417/410.1

* cited by examiner

*Primary Examiner*—Charles G. Freay
(74) *Attorney, Agent, or Firm*—Bachman & LaPointe, PC

(57) ABSTRACT

A compressor assembly includes a compressor having a known vibration frequency when operated at normal operating parameters; and an electric box assembly having a frame member mounted to the compressor for containing electrical components related to the compressor, the electric box assembly having a natural frequency which is different from the known vibration frequency. This avoids amplification of vibration into the electric box assembly and thereby protects the assembly from damage due to same.

13 Claims, 3 Drawing Sheets

ELECTRIC BOX FOR COMPRESSOR ASSEMBLY

BACKGROUND OF THE INVENTION

The invention relates to compressors and, more particularly, to the design of an electric box for a compressor assembly.

The electric box of a compressor assembly is a support structure typically mounted to the compressor for holding various electronic components of the assembly, such as electronic protection boards, compressor contactors, transformers and the like. During operation, a compressor generates vibrations. These vibrations can lead to damage to the electric box itself and to the components therein.

Based upon the foregoing, it is clear that the need remains for an improved compressor assembly wherein the electric box and components contained therein are less susceptible to damage due to compressor vibration.

It is therefore the primary object of the present invention to provide a compressor assembly wherein the electric box and components mounted therein are subjected to reduced risk of damage from compressor vibration.

Other objects and advantages of the present invention will appear hereinbelow.

SUMMARY OF THE INVENTION

In accordance with the invention, the foregoing objects and advantages have been readily attained. According to the invention, a compressor assembly is provided which comprises a compressor having a known vibration frequency when operated at normal operating parameters; and an electric box assembly comprising a frame member mounted to the compressor for containing electrical components related to the compressor, the electric box assembly having a natural frequency which is different from the known vibration frequency.

In further accordance with the invention, a method is provided for designing an electric box assembly for a compressor assembly, which method comprises the steps of determining a known vibration frequency for a compressor at normal operating parameters; and providing an electric box assembly comprising a frame member for supporting electrical components related to the compressor, wherein the electric box assembly has a natural frequency which is different from the known vibration frequency of the compressor.

By providing the electric box with a natural frequency which is sufficiently different from the natural frequency of the compressor, excessive amplitude of vibration of the electric box can be avoided leading to reduction in stresses to the electric box and components mounted therein, and a resulting increase in lifetime of these electric components.

BRIEF DESCRIPTION OF THE DRAWINGS

A detailed description of preferred embodiments of the present invention follows, with reference to that attached drawings, wherein.

DETAILED DESCRIPTION

The invention relates to a compressor assembly and, more particularly, to an electric box assembly for a compressor assembly which is mounted to the compressor and which contains various electrical components related to the compressor.

In accordance with the invention, the electric box assembly is designed to have a natural frequency which is different from the known vibration frequency of the compressor at normal operating parameters, whereby vibrations from the compressor are at a different frequency than the natural frequency of the electric box. This advantageously avoids potential increases in vibration amplitude which could result if the natural frequency of the electric box assembly coincides with that of the compressor.

Figure 1:
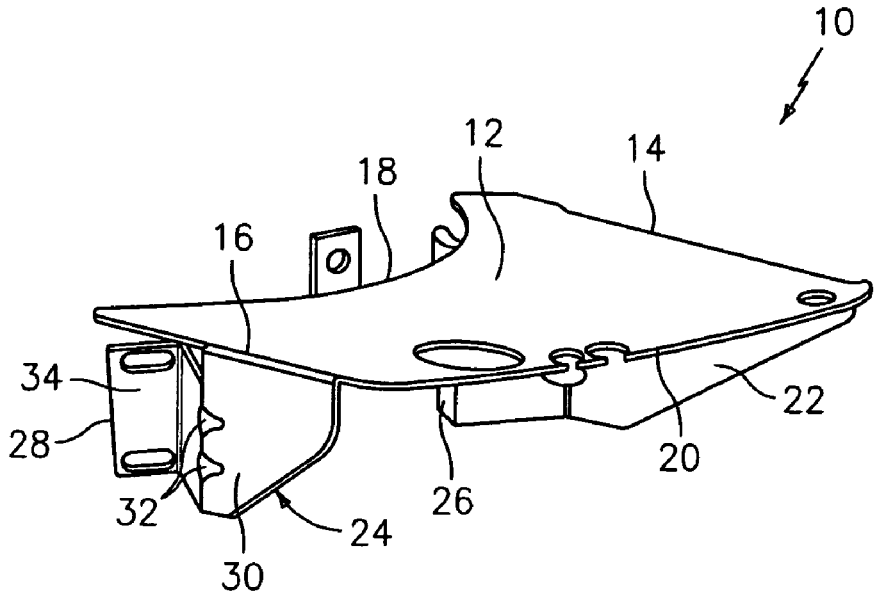
FIG. 1 is a perspective view of a frame member of an electric box assembly in accordance with the present invention.
Figure 2:
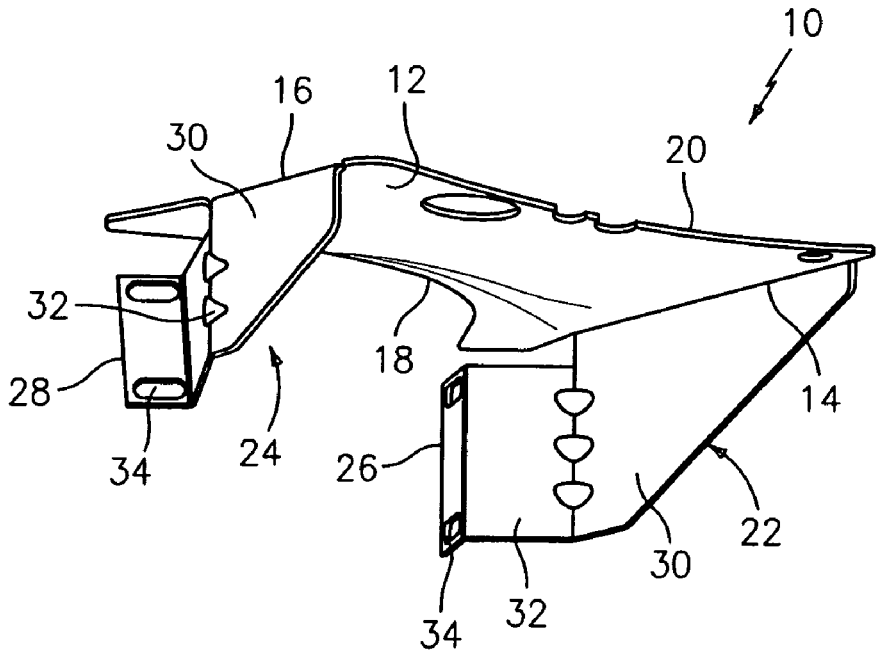
FIG. 2 is a further perspective view of the frame member in accordance with the present invention.
Figure 3:
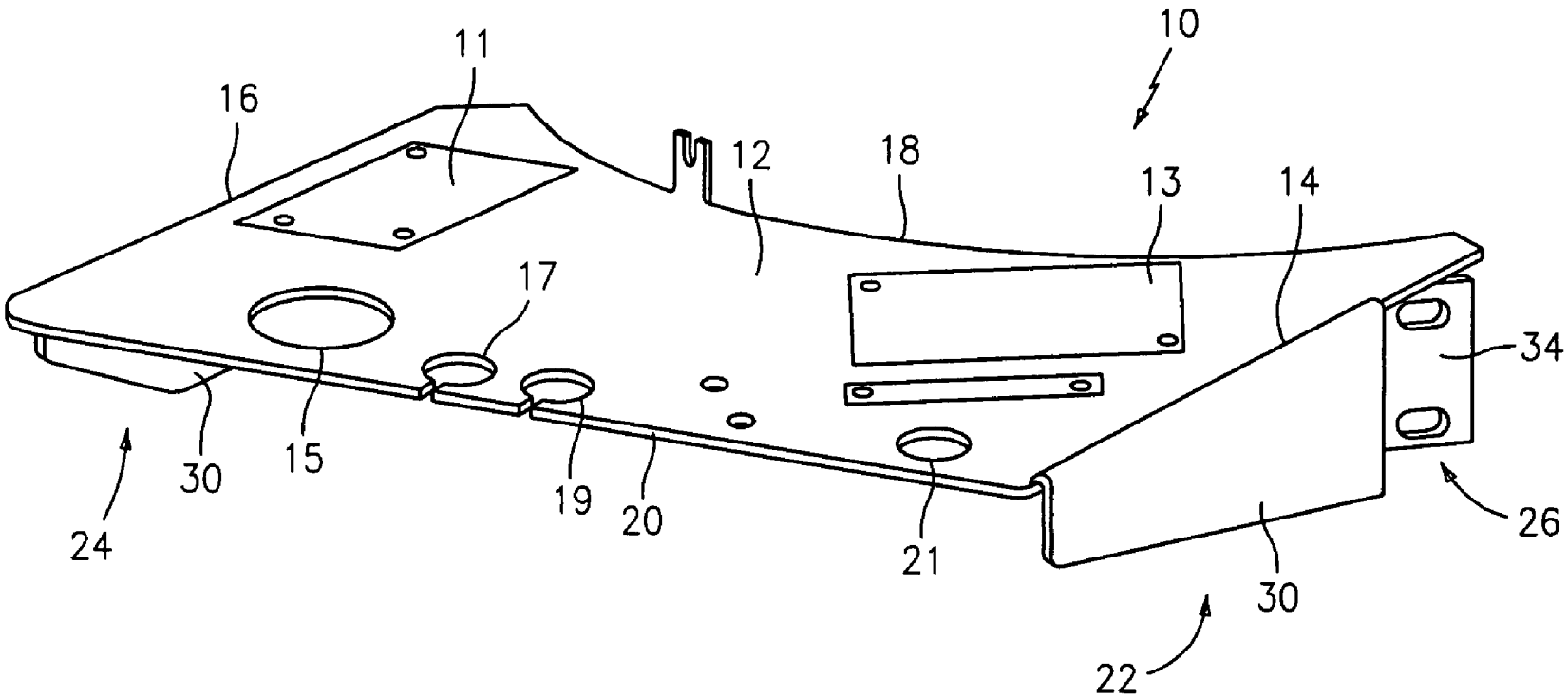
FIG. 3 is a further view of a frame member with electric components according to the invention.

FIGS. 1 and 2 show an electric box assembly including a frame member 10 for a compressor assembly in accordance with the present invention. Frame member 10 includes a substantially flat plate portion 12 having two side edges 14, 16, a rear edge 18 and a front edge 20. In the design shown in FIGS. 1 and 2, two side flanges or members 22, 24 are positioned and extend substantially downwardly from side edges 14, 16.

In its environment of use (See also FIG. 4) electric box frame member 10 is mounted to a compressor 1 at rear edge 18 and at the rear edges 26, 28 of side members 22, 24 respectively.

This can be done using any suitable mechanical fastening structures, which would be well known to person of ordinary skill in the art.

Plate 12 is typically provided having a series of holes and other structures which are adapted for use in mounting various electrical components thereto. The positioning and size of these holes will depend upon the components and would be well known to a person of ordinary skill in the art. For example, frame member 10 can have components 11, 13, mounted thereto, and can have holes or openings 15, 17, 19, 21 for electric cables and the like.

Side members 22, 24 can be provided having a first portion 30 which is substantially parallel to side edge 14, 16 from which they extend. Side members 22, 24 can also be provided having a second portion 32 which extends inwardly, or toward the other side member 22, 24, and then a third portion 34 extending from the inner edge of second portion 32 to define a contact surface for securing to the compressor as desired. This structure advantageously allows for stiffening frame member 10 and, thereby, allows for providing the desired natural frequency.

Further, frame member 10 can be further structurally stiffened, if desired, by providing indentations along corners of the structure. FIGS. 1 and 2 show such indentations 38 positioned along corners defined between portions 30, 32 and 34 of side flanges 22, 24. These indentations serve to resist flexing at the corner and thereby increase the mechanical stiffness of frame member 10. It should of course be appreciated that indentations can be provided at other locations of frame member 10 as well.

In accordance with the invention, the shape, including arrangement of parts and the dimensions of electric box assembly, as well as the stiffness of the material and stiffness of frame member 10 due to the specific structure selected, will produce a natural frequency of vibration of the electrical box assembly. When subjected to vibrations at this natural frequency, there is a risk that dynamic excitation of the compressor will result in even greater levels of vibration amplitude in the box assembly, which can cause the problems mentioned above in connection with excessive wear upon components mounted therein and stress to frame member 10, and avoidance of these problems is the object of the present invention.

This is advantageously accomplished in accordance with the present invention by designing electric box frame member 10 so that the box assembly has a natural frequency which is preferably at least about 10% greater than the known vibration frequency of the compressor at normal operating parameters. For example, if operation of the compressor at normal operating parameters results in a vibration having a frequency of 50 Hz, electric box assembly 10 is preferably designed to have a natural frequency of at least about 55 Hz, preferably between about 55 Hz and about 90 Hz. To adapt these ranges to other types of compressors having different operating vibration frequency it is preferred to provide the natural frequency at least 10% greater than the expected vibration frequency of the compressor, and more preferable that the electric box assembly be designed to have a natural frequency which falls in a range of frequencies which are between about 10% and about 80% greater than the expected frequency of the compressor. This advantageously serves to avoid a natural frequency of the electric box assembly which is a multiple of the frequency generated by the compressor, which could also result in undesirable enhancement of amplitude vibration of in the electric box assembly.

As set forth above, the important parameters for use in providing a desired natural frequency of the electric box assembly of the present invention include the dimensions of the frame member, the material from which the frame member is made, and the orientation of various components of the frame member relative to each other. The electrical components mounted in the frame member can also affect the natural frequency and should be taken into account.

In accordance with the present invention, the natural frequencies of a desired structure are preferably estimated using a finite element simulation model, and the resulting estimated natural frequency can then be verified by testing on a vibration shaker while measuring the resulting amplitude of vibration in the assembly. By following this procedure, and utilizing the simulation model, the electric box assembly can be designed so as to have the desired natural frequency as set forth above. Of course, other methods can be used for providing an electric box assembly having the desired natural frequency.

Parameters of the electric box assembly which can be adjusted in the simulation process include the stiffness of the material from which the frame member is manufactured, thickness of the material, stiffening structures, and the various dimensions as set forth above.

Figure 4:
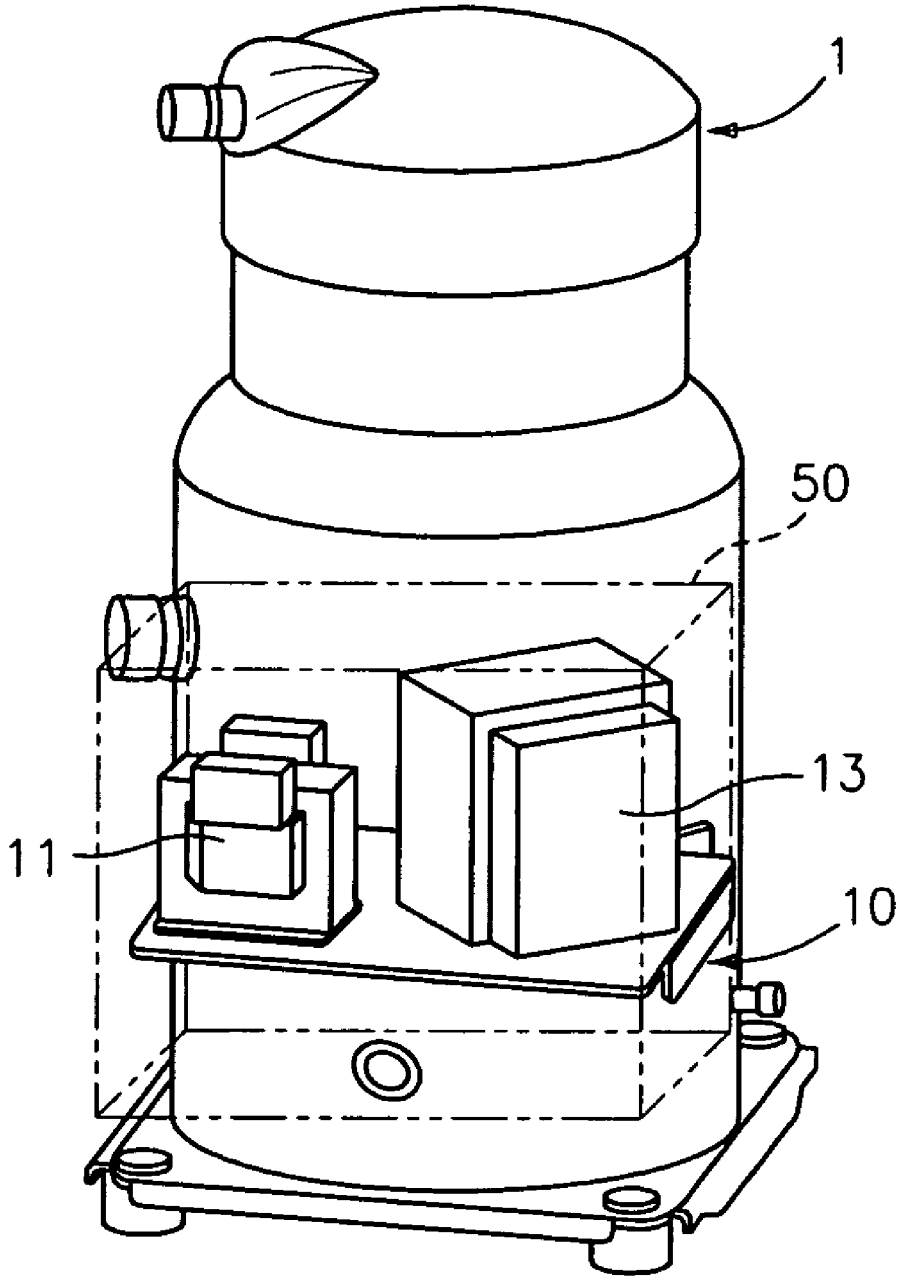
FIG. 4 shows an electric box assembly mounted to a compressor.

Frame member 10 is typically provided with a cover 50 as shown in dashed lines in FIG. 4, but cover 50 has been found to have no significant impact upon the natural frequency of the electric box assembly.

Frame member 10 can be provided of any suitable materials, including various sheet metals, plastics, ceramics and the like.

It should be noted that providing an electric box in accordance with the present invention advantageously serves to reduce the damage to the electric box and components mounted therein due to vibration of the compressor.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A compressor assembly, comprising:

a compressor having a known vibration frequency when operated at normal operating parameters; and an electric box assembly comprising a frame member mounted to the compressor for containing electrical components related to the compressor, the electric box assembly having a natural frequency which is different from the known vibration frequency.

2. The assembly of claim 1, wherein the natural frequency of the electric box assembly is at least 10% higher than the known vibration frequency.

3. The assembly of claim 2, wherein the natural frequency of the electric box assembly is between about 10% and about 80% higher than the known vibration frequency.

4. The assembly of claim 1, wherein the frame member comprises a substantially flat plate having side edges, and further comprises two side flanges arranged substantially perpendicular relative to the flat plate, the flat plate and the side flanges each having rear edges which are mounted adjacent to the compressor.

5. The assembly of claim 4, wherein corners are defined by at least one of the flat plate and side flanges, and further comprising indentations along the corners for stiffening the frame member.

6. The assembly of claim 4, wherein the side flanges have first portions which are substantially parallel and second portions angled toward each other.

7. The assembly of claim 6, wherein corners are defined between the first portions and the second portions, and further comprising indentations along the corners for stiffening the frame member.

8. The assembly of claim 1, wherein the electric box assembly further comprises electric components, and wherein the frame member and the electric components together define the natural frequency of the electric box assembly.

9. A method for designing an electric box assembly for a compressor assembly, comprising the steps of:

determining a known vibration frequency for a compressor at normal operating parameters; and providing an electric box assembly comprising a frame member for supporting electrical components related to the compressor, wherein the electric box assembly has a natural frequency which is different from the known vibration frequency of the compressor.

10. The method of claim 9, wherein the natural frequency of the electric box assembly is at least 10% higher than the known vibration frequency.

11. The method of claim 9, wherein the natural frequency of the electric box assembly is between about 10% and about 80% higher than the known vibration frequency.

12. The method of claim 9, wherein the frame member comprises a substantially flat plate having side edges, and further comprises two side flanges arranged substantially perpendicular relative to the flat plate, the flat plate and the side flanges each having rear edges which are mounted adjacent to the compressor.

13. The method of claim 9, wherein the providing step comprises:

electric box assembly configuration; evaluating expected natural frequency of the starting electric box assembly configuration; and modifying the starting electric box assembly to provide the natural frequency which is different from the known vibration frequency of the compressor.

* * * * *